US005147266A

United States Patent [19]

Ricard

[11] Patent Number: 5,147,266

[45] Date of Patent: Sep. 15, 1992

[54] LEG STRETCHING MACHINE

[76] Inventor: Roger W. Ricard, 1401 Bell Trace Rd., Antioch, Tenn. 37013

[21] Appl. No.: 667,770

[22] Filed: Mar. 11, 1991

[51] Int. Cl.[5] ..... A63B 23/04

[52] U.S. Cl. ..... 482/131; 482/133; 482/907

[58] Field of Search ..... 272/70, 142, 127, 144, 272/126, 127, 134, 903, 93, 97, 116, 146, 138; 128/26 R

[56] References Cited

U.S. PATENT DOCUMENTS

| | | | |
|---|---|---|---|
| 219,439 | 9/1879 | Blend | 128/25 R |
| 3,620,530 | 11/1971 | Cosby | 272/142 |
| 4,506,884 | 3/1985 | Hankin | 272/127 |
| 4,779,862 | 10/1988 | Keppler | 272/70 |

*Primary Examiner*—Richard J. Apley
*Assistant Examiner*—J. Donnelly
*Attorney, Agent, or Firm*—Richard C. Litman

[57] ABSTRACT

A stretching machine for performing the Chinese split includes a base, two generally horizontal tracks extending colinearly from the base, a foot platform sliding on each track, and a vertical column with handles. The user stands on the platforms, which travel outward from the base while the split is performed, and maintains balance by holding the handles. The platforms are moved along the tracks by cables fixed to either side of each platform. The cables run over pulleys to a drum mounted in the column, which can be turned by a crank. A novel aspect is a slight angular inclination between the tracks, allowing a deeper split.

14 Claims, 4 Drawing Sheets

LEG STRETCHING MACHINE

FIELD OF THE INVENTION

The present invention relates to machines for stretching muscles, particularly machines for practicing the Chinese split in which the legs are spread apart and the muscles and tendons of the inner thigh are stretched while the torso remains upright.

DESCRIPTION OF THE PRIOR ART

Stretching machines, for systematically lengthening a muscle or tendon, are used for both therapy and for athletic purposes. Some muscle stretching machines are designed for particular muscles or muscle groups. Several devices in the prior art are devoted to stretching or exercising the muscles of the inner thigh.

One example is disclosed in U.S. Pat. No. 3,584,871 issued to Kelmon and Kelmon, Jr. The Kelmon device comprises a pair of wheeled platforms connected by elastic ropes. The user stands with one foot upon either platform. The wheels are aligned so that the two platforms move toward and away from each other. As the platforms roll apart and the user's feet separate, the elastic rope exerts increasing force to return the two platforms towards each other.

The Kelmon device necessarily exerts a restoring force proportional to the separation of the two platforms. This limits its adaptation to the various sorts of exercise (such as isotonic, isokinetic, etc.) and makes it unsuitable for stretching of the muscles of the inner thigh (as opposed to exercising those muscles) because the angular extension of the legs becomes more and more difficult as the angle between the legs increases. Also, the device is not easy to use if the user wishes to do a Chinese split, where the torso is held upright and the legs are extended quite far apart within the coronal (frontal) plane of the torso. As the legs separate the position of the user becomes more and more precarious. Since no hand hold is provided, toppling will result.

(The American split is the split in which the legs are extended normal to the frontal plane of the torso, and extend in two parallel for-and-aft line rather than a single transverse line.)

A similar device is shown by Wilson in U.S. Pat. No. 4,132,404. Wilson substitutes omnidirectional rollers for the unidirectional aligned wheels of Kelmon underneath the platforms, to allow motion of the platforms in all directions instead of only in one line. The rope of Wilson is non-elastic.

A mechanical leg stretching apparatus is taught by Ehrenfried in U.S. Pat. No. 4,456,247, and is shown in the drawing FIG. 1, labeled as prior art. The apparatus includes a base which rests on the floor, an adjustable backrest, and two leg supports which move in the plane of the floor. The leg supports are connected to cables which run to pulleys within the base. The cables extend up inside an arm located between the user's legs, and are wrapped about a drum at the top of the arm. The drum is connected to a crank for turning of the drum by the user, and to a ratchet and pawl to lock the drum against rotation. In addition to the mechanism consisting of the drum and crank, there is a second mechanism for tightening the cables. The upright arm is pivoted on a pin for motion toward and away from the user's torso. The cables' run takes them over this pin, which is surrounded by a roller inside the arm where the wires touch it. The arrangement is such that when the arm is moved over the pivot, the cables are pressed against the roller pin or released, and thus tightened or loosened to exert forces on the leg supports.

The Ehrenfried machine forces the users legs apart, and also exerts components of those forces against the torso of the user, tending to slide the user away from the arm. This means that the backrest must be maintained at an elevated angle to provide a component of the user's weight to counteract the force of the leg supports; otherwise, the user will simply slide away from the arm. The weight of the user is ineffectively used to oppose the stretching force. Friction of the user's back side against the backrest and base aids the user in staying put, but, the friction tends to wear the user and his or her clothing.

The Ehrenfried machine does not push against the user's feet, but rather against the user's legs. Since the legs are the natural point for exerting leg forces, the device perhaps does not train as effectively as one which exerts foot forces.

Another Ehrenfried patent, U.S. Pat. No. 4,647,040 discloses a similar device to his '247 device.

Hestilow, in U.S. Pat. No. 4,844,453, shows a stretching machine similar to Ehrenfried's machines in having pivotally mounted leg supports.

Ruff, in U.S. Pat. No. 4,445,684 describes a device which includes a seat, a shaft running outward from under the seat, and a member sliding on the shaft. Two rods are pivoted on the sliding member. At the ends of the rods distal the sliding member are pads against which the user's legs may push. A crank on the shaft retracts a rope which pulls the sliding member along the shaft toward the seated user.

Hermelin, in U.S. Pat. No. 4,512,571, shows an exerciser with two pedals moving in parallel tracks on a base, and upright frame and the end of the base, and handles at the ends of cables which run over pulleys on the upright frame. The handles are connected to the pedals by the cables running over a pulley system. A user may stand on the two pedals and move the feet in parallel, as in walking, while exerting forces with the hands.

U.S. Pat. No. 4,506,884 of Hankin teaches an elongated base which includes tracks, on which two platforms slide toward and away from each other. At one side of the base, near the center, a user support handle structure is removably mounted. A user may grip this while standing on the two platforms and moving the feet toward and away from each other.

In one embodiment of Hankin's invention, the frame comes apart at the midpoint for storage and the handle is in the shape of an inverted U.

In another embodiment, the frame is unitary and a T-shaped support handle is attached one side at the midpoint, to a member under the base or frame. The plane of the T is parallel to the length of the base, and the T handle is pivotally clamped at its lower end for adjustment to positions toward or away from the base of the machine. This second embodiment may include a drum or roller atop the T handle with a crank on the roller, and cables wrapped about the drum leading first to pulleys and thence to either platform. Only a single cable is run to either platform. The platforms may be retracted from an extended position by turning the crank, but there is no positive return.

The crank may be locked in position by inserting a pin through holes in the drum and handle. This method is difficult while in a deep split position, as it requires alignment of the drum to a precise position with one hand and picking up and inserting the pin with the other, all the while balancing the torso.

The Hankin device is intended mainly to be used in a kneeling position. This is shown by Hankin's explicit statement (col. 1, line 46) and by his claim (col. 5, lines 25–27) to platforms sized for shins (not for feet). Hankin's handle is short, for grasping by a kneeling person (this is clear from his FIG. 6). His FIGS. 11–13 show only kneeling use of the device. No standing use is shown, nor is it mentioned. Also, the bearings 66 which allow the platforms 70, 72 to rotate are a hindrance for standing exercises.

None of the above inventions and patents, taken either singly or in combination, is seen to describe the instant invention as claimed The prior art does not disclose a compact device for practicing the Chinese split which is adapted to deep Chinese splits from a standing position, aided by gravity, where there is provision for recovering to a standing position without undue stress on the leg muscles.

Accordingly, one object of the present invention is a machine for practicing the Chinese split which allows a user to easily recover from a position in which the legs are spread far apart.

Another object of the present invention is a machine with straight tracks for foot platforms which are slightly inclined to allow deeper splits and easier return to the standing position.

A further object is a machine for practicing splits which stores compactly and moves easily from place to place.

A final object is a machine which includes means for positive displacement of the feet to avoid muscle strain in reaching and recovering from a split position.

These and other objects of the present invention will become readily apparent upon further review of the following specification and drawings.

SUMMARY OF THE INVENTION

The present invention is a stretching machine for performing the Chinese split which includes a base, two generally horizontal tracks extending colinearly from the base, a foot platform sliding on each track, and a vertical column with handles. The user stands on the platforms, which travel outward from the base while the split is performed, and maintains balance by holding the handles. The platforms are moved along the tracks by cables fixed to either side of each platform. The cables run over pulleys to a drum mounted in the column.

The tracks are slightly inclined for deeper splits.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
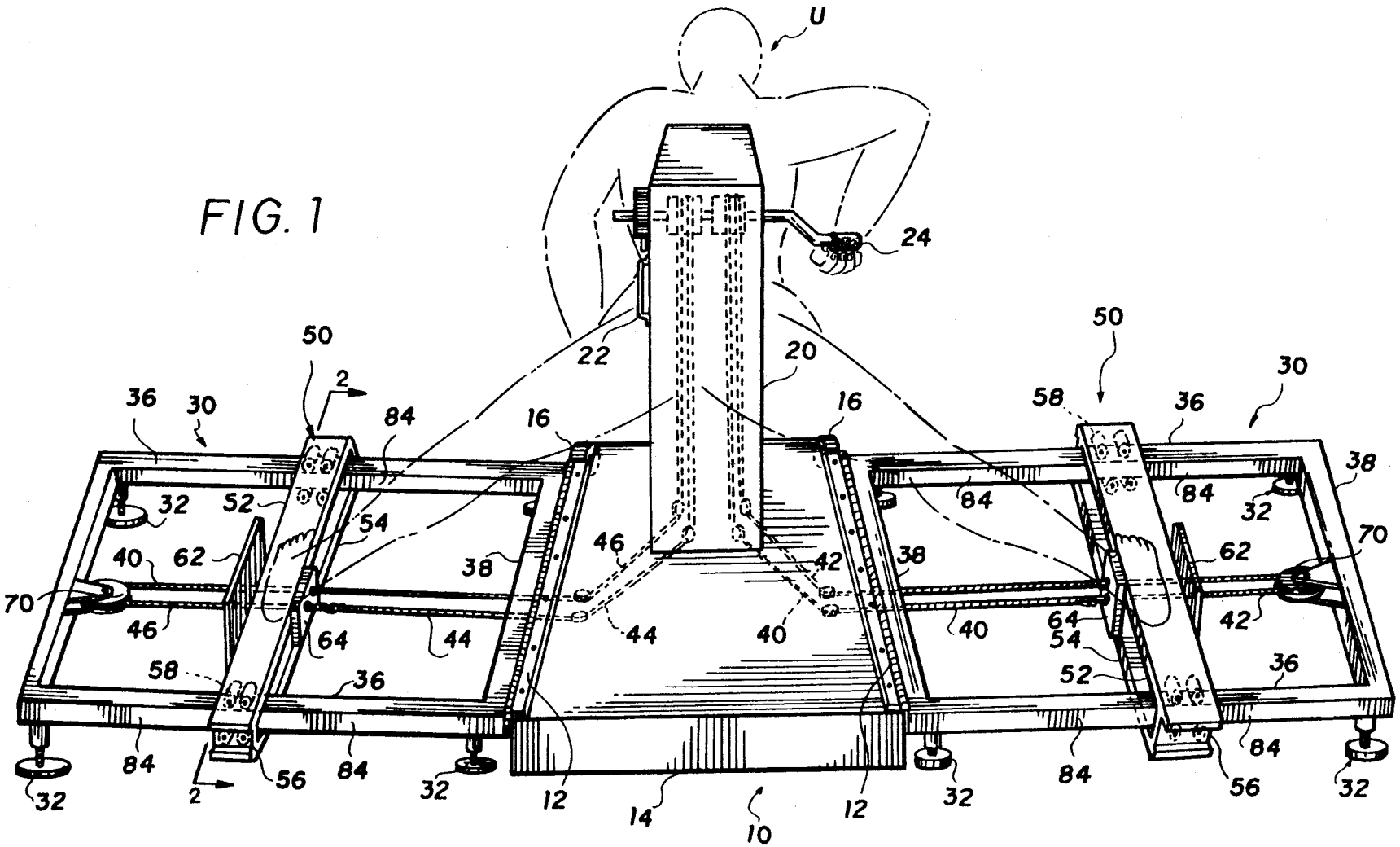
FIG. 1 is a perspective view of the present invention showing the base, tracks, platforms and central column.

The present invention is a stretching machine for performing the Chinese split. As shown in FIG. 1, it consists essentially of left and right foot platforms 50, which slide apart on respective tracks 30 for the user U to stand on while doing a split, and, a column 20 with a handle 22 for the user to grasp meanwhile to maintain balance.

(The two tracks 30 and their respective platforms 50 are designated in the following specification and claims as "left" and "right". These terms may be construed as arbitrary, depending upon the side of the machine on which an observer stands. Therefore, to avoid arbitrary usage, the term "left" will denote the platform and track on which the user U normally stands, and the term "right" conversely. In FIG. 1, the right platform 50 is on the right side of the drawing page.

To avoid clutter, one drawing number will denote both left and right elements.)

The usefulness of the present invention is greatly increased by two improvements. One is a means for positive displacement of the platforms 50 both toward and away from each other, which relieves the muscles of the user's legs from strain (the invention is for stretching, not exercise); this object is met by a system of cables 40, 42, 44, 46. The second is the formation of an obtuse angle between the left track and the right track, which allows the user to stretch his or her legs to an angle more than 180 degrees—greater than is possible with one straight track. The two tracks 30 are hinged to a base 10 and have end pedestals 32 which are higher than the supports of the base 10; this angles either track to the floor on which the machine rests.

Still referring to FIG. 1, it will be seen that the base 10 is rectangular in outline, having two sides whereon hinges 12 are attached for the tracks to rotate. The base may be constructed by any suitable method and of any material which is sturdy enough. The base includes a front support 14 (or feet as an alternative) and two rear wheels 16 having an axis perpendicular to the sides to hold the base parallel to the floor.

The wheels allow the machine to be wheeled about easily. (The wheels rest on the floor in normal use, and also when the machine is wheeled about.) When the tracks are folded upward along the hinge 12 axis on the sides of the base 10, they will come to rest against each other and attach by a latch to each other. The column 20 or its handle 22 may then be grasped, the machine base 10 tilted upward on the wheels 16, and the whole unit wheeled away with most of its weight on the two base wheels 16.

To allow room for the wheels 16 to be mounted upon the sides of the base 10, the base 10 is extended beyond the tracks 30 as shown in FIG. 1.

The left and right tracks 30 which are hinged to the sides of the base 10 are mirror images, nearly identical. Each track 30 is basically a rectangular frame with two parallel rails 36, extending perpendicular to the hinge 12 axis, on which the foot platform 50 slides. The rails 36 are preferably two inch square stock metal tubing, aluminum for lightness. The end bars 38 of the frame may also be made of this same stock and the whole track 30 welded together.

The track 30 end pedestals 32 support the weight of the user U, who stands on the platforms 50 which slide on the track rails 36. These outer pedestals 32 are of such a length that the outer ends of the tracks 30 are slightly higher than the inner ends. This inclines each track to the floor by an angle $\phi$, and the tracks to each other (assuming the usual flat floor under the machine). By this inclination the user can bring his or her crotch to a lower position relative to the feet and so spread his or her legs to a greater angle. This also enables the user to return to the standing position with greater ease as opposed to a track lying parallel to the floor, because the feet are moving downward and the torso need not rise so high.

Figure 4:
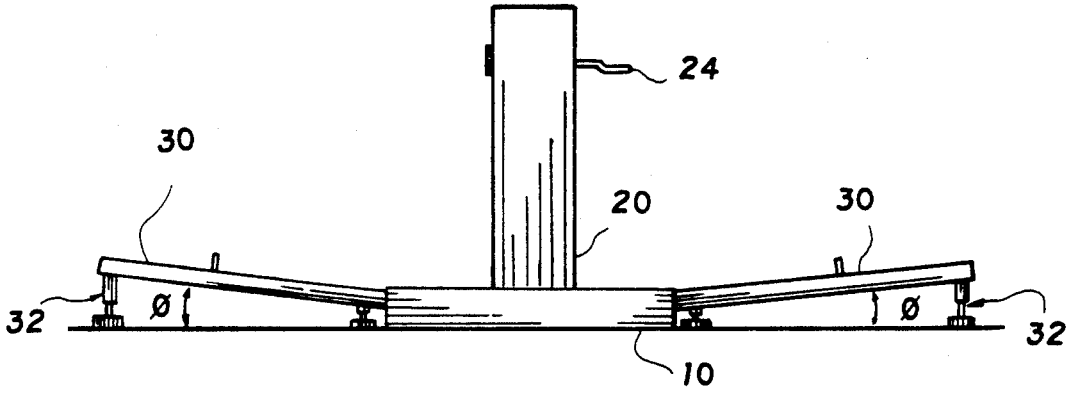
FIG. 4 is a schematic view repeating FIG. 1, showing the positions of the tracks as they rotate about their respective hinges, and the angle $\phi$ of the tracks.

The angle $\phi$ is shown in FIG. 4, a schematic view which repeats the matter and perspective of FIG. 1.

The pedestals 32 may be made of adjustable length if desired. Adjustable threaded pedestals 32 are shown in the drawing.

Figure 2:
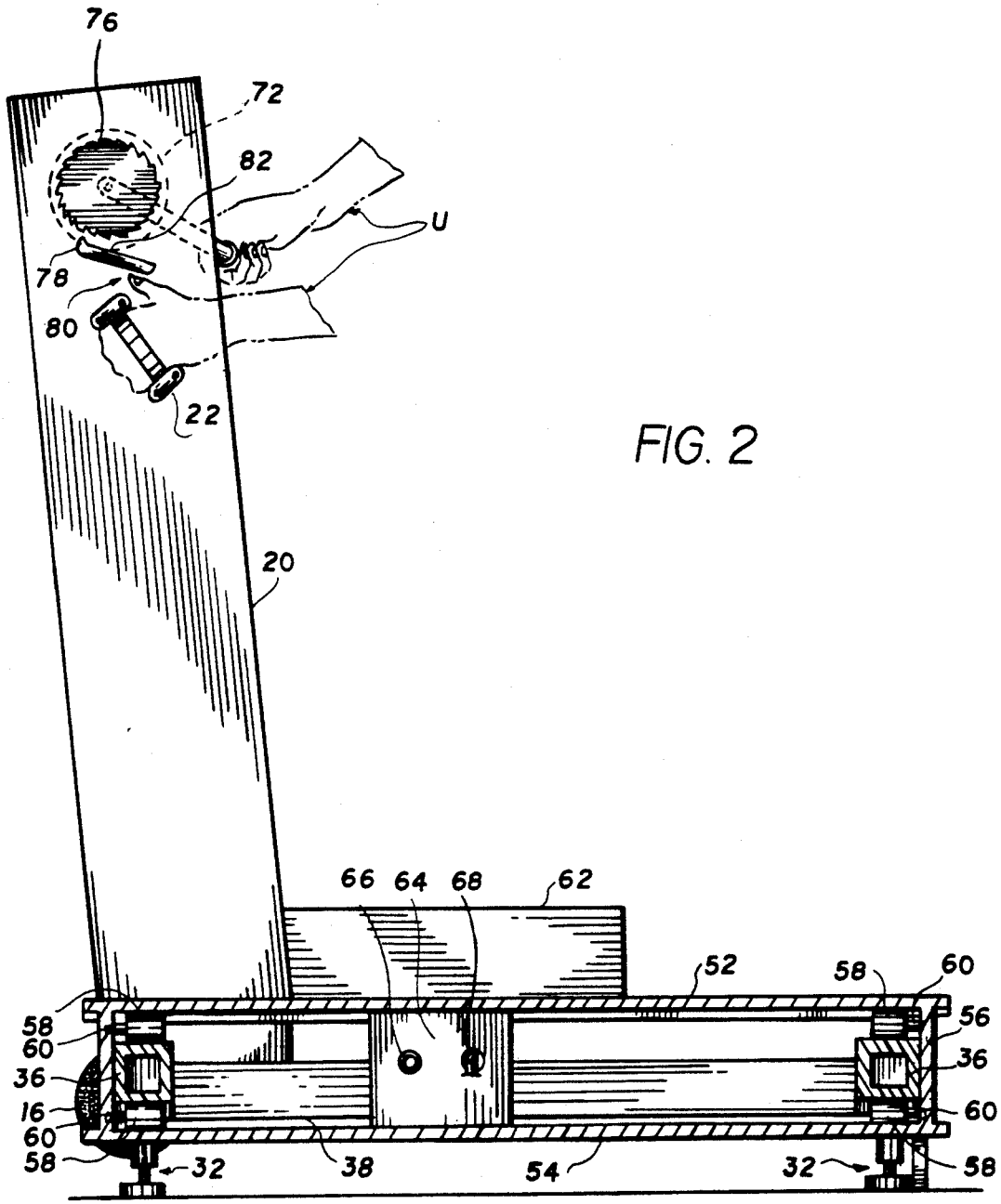
FIG. 2 is a cross sectional elevation view along section line 2—2 of FIG. 1.

The platforms 50 are also shown in FIG. 2, which is a cross section through the left platform along line 2—2 of FIG. 1. Each comprises a top plate 52 and a bottom plate 54 disposed respectively above and below the rails 36; end channels 56 which bolt to the top and bottom plate ends and fix them relative to one another; and rollers 58 which contact the rails. The rollers turn on axles 60 bolted through the end channel walls. A total of eight rollers 58 are included in each platform: four sets disposed in a rectangle, each set further comprising a pair including an upper and a lower roller, as shown in FIG. 1. The eight constrain the platform 50 to move in a plane defined by the two parallel rails 36.

Each platform 50 includes a foot stop 62 on the outer platform edge (or alternatively, on both inner and outer edges) perpendicular to the direction of platform motion. This prevents the foot of the user U from sliding off the platform. The platform 50 top surface may also be covered with a friction coating or rough paint for footing.

The central column 20 is mounted at one end of the base 10, equidistant between the base sides where the hinges 12 are mounted. The column is firmly attached to the base, as it must resist substantial forces. It is conveniently made with a rectangular cross section as best shown in FIG. 1. It could also be made cylindrical, as an open framework, or in any other convenient form.

The column includes at least one handle 22 which is grasped by the user U when in the split position for maintaining balance. In the preferred embodiment, there is one handle 22 on the left-hand side of the column 20 and a crank handle 24 on the right-hand side. (The choice of sides is dictated by the usual right hand preference of the user. The positions could be reversed for left handed people.) The crank handle 24 may be used as a handle for balance, and also works the platform displacement apparatus.

As can be seen in FIG. 2, the column 20 is tilted away from the vertical. This tilt aids the user in maintaining balance while in a deep split, by causing a tilt of the pelvis. It also decreases the danger of falling.

The column 20 contains a mechanism for positive displacements of the platforms. The cables 40, 42, 44, 46 and the crank handle 24, discussed above, are part of this mechanism.

The platforms are positively displaced either toward or away from the base 10 by cables 40, 42, 44, 46 connected through the mechanism to the crank handle 24. When the crank turns through a certain angle, each platform will move the same distance away from the base. If the crank turns through that same angle, but in the opposite sense, the platforms will return equally toward the base. Thus the platforms are always the same distance away from the base. Parallel rails 36 of tracks 30 include distance indicia 84 thereon for measuring the distance of platforms 50 from base 10.

This positive displacement is an important aspect of the functioning of the present invention. The displacements may be labeled as retractions (inward) or extensions (outwards).

The retraction displacement is the most important. When a person is in a deep split, the leverage of the muscles of the inner thigh, in swiveling each leg back toward the other, is greatly reduced. Recovery by muscle power alone is difficult. With the present invention, the user may turn the crank to bring the platforms together and recover without strain, or even effort, by the muscles of the inner thigh.

Positive displacement is also important in the case of extension, when going into the split. Much less force is needed to move the torso downward and the legs apart, because of gravity. But, gravity is an uncontrollable force. It acts constantly on the torso while its torque on the legs increases with the angle of the legs throughout the split.

There are two ranges. Through the first part of the split, effort to resist the fall of the torso must be exerted. At some point the tension caused by stretching the leg tendons will equal that of gravity. Beyond that point, in the final range, gravity cannot cause any more stretching.

The extension displacement mechanism of the present invention is most important in the last range, where gravity cannot supply the stretching force and the muscles of the outside of the thigh (e.g., lateral vastus) are in a position where they can exert little leverage.

Figure 3:
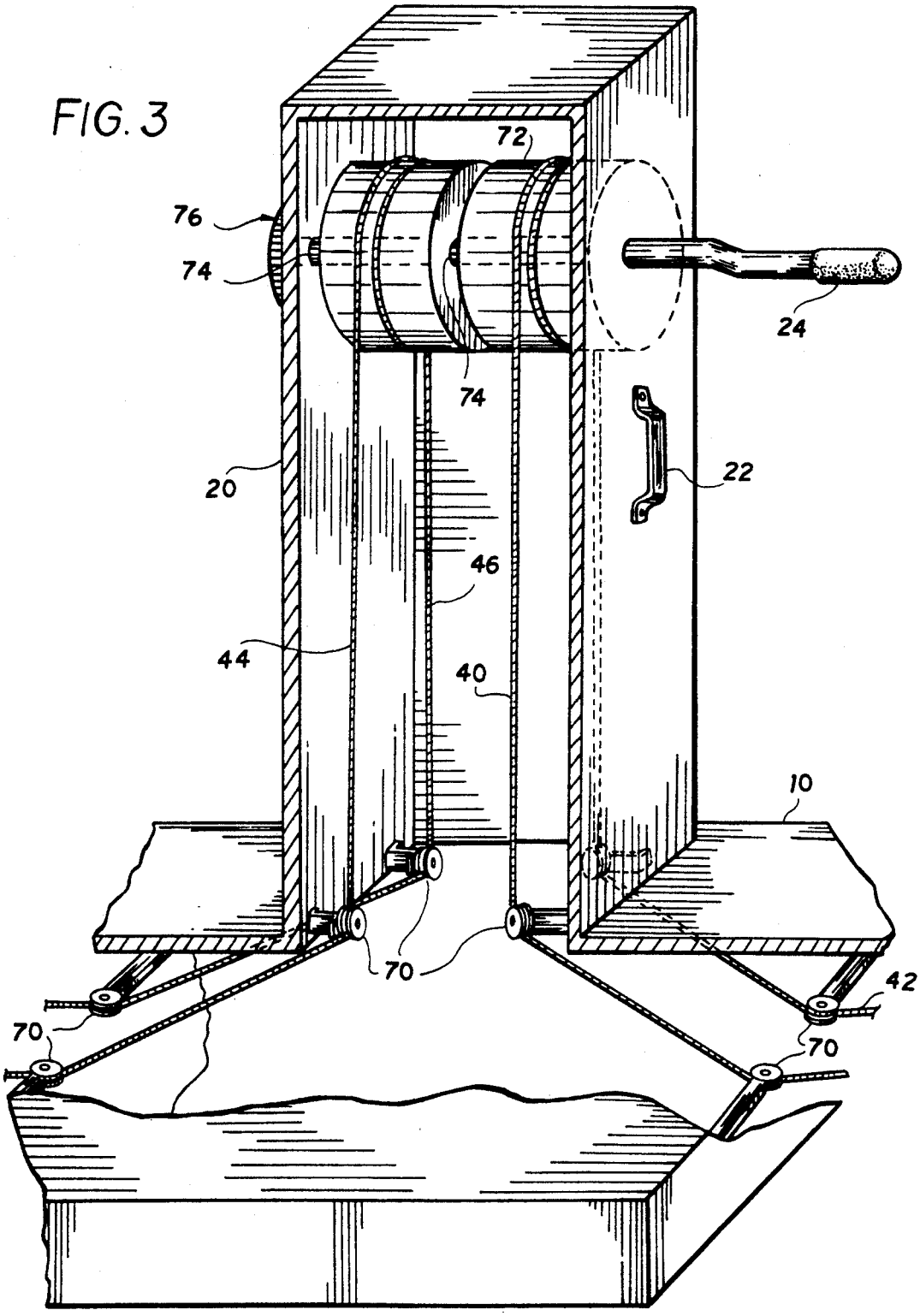
FIG. 3 is a perspective cutaway view of the column, showing the cables and drum inside which control the positions of the platforms on the tracks.

The displacement mechanism consists of cables 40, 42, 44, 46 which attach to either side of each platform 50 to pull it toward or away from the base 10, pulleys 70, and drums 72 in the column around which the cables 40, 42, 44, 46 are wrapped. As best shown in FIG. 3, two retraction cables, one destined for either platform, come off one side of the drums, and pass over and around pulleys 70 to their respective platforms 50. The extension cables come off the opposite side of the drum 72. Thus both platforms 50 will move outward or inward simultaneously when the drum 72 is rotated and opposing cables of either platform 50 pay out or wind up.

There are four numbered cables shown in FIGS. 1 and 3: right retraction cable 40, right extension cable 42, left retraction cable 44, and left extension cable 46.

As shown in FIG. 1, the extension cables 42, 46 pass through an aperture 66 in a cable plate 64 fastened between the top 52 and the bottom plate 54 of the platform 50. Each then reverses direction over a pulley 70 fastened to the midpoint of either end bar 38, and returns to the cable plate 64. The cable terminates on a cable end fitting 68. The retraction cables pass, more directly, to another cable end fitting 68 directly across the cable plate 64 from the cable end fitting 68 which terminates the same-side extension cable.

In practice, the two right (or left) numbered cables may actually be one cable wrapped repeatedly around a single drum. (There can be two drums, as shown in FIG. 3, or four drums with one cable on each.) Since the friction of a cable wrapped around a drum increases exponentially with the total angle of wrap, only a few turns would suffice to prevent slippage of the cable. Thus, the four cables recited in the claims are so listed for explication. In practice any number of cable segments could be used. (In theory, even a single endless loop of cable could be used, but this would be impractical.)

The drums 72 include an axle 74 that extends through the wall of the column 20 and mounts a crank and a crank handle 24 for manual turning of the drums 72. As mentioned above, this crank handle 24 is positioned on the opposite side of the column 20 from the handle 22.

The axle 74 extends from the other end of the drums 70 through the side of the column 20 opposite the crank 24 to a ratchet wheel 76. A pawl 78 engages the wheel 76. The teeth of the ratchet wheel 76 and the pawl 78 are aligned so as to hold the drums 72 from turning in the sense that corresponds to paying out the extension cables, i.e., to the platforms moving apart.

The pawl 78 is held between the ratchet 76 teeth by gravity. The elongated arm of the pawl 78 pivots about a pin 82; the arm is unbalanced so that it is normally engaged. The pawl includes a finger catch 80 situated so that the thumb of the user's hand, resting on the handle 22, can push up the finger catch 80 to release the ratchet wheel 76 and allow turning of the drums 72 to recover from a Chinese split. The pawl could also be held in engagement by a spring.

The drums, pulleys etc. could be replaced with a different but equivalent mechanism, for example a geared-down electrical motor, without changing the nature of the invention.

In general, it is to be understood that the present invention is not limited to the sole embodiment described above, but encompasses any and all embodiments within the scope of the following claims.

I claim:

1. A stretching machine for performing splits comprising:

a base, for resting on a floor, including an end, a right side, and a left side, a right hinge mounted upon the right side, a left hinge mounted upon the left side, the right hinge having an axis parallel to the axis of the left hinge and to the floor when the base is resting upon the floor, the axis of the right hinge and the axis of the left hinge equidistant from the floor;

a straight right track attached to the right hinge, whereby the right track may rotate from the resting position on the floor to an elevated storage position;

a straight left track attached to the left hinge, whereby the left track may rotate from the resting position on the floor to the elevated storage position;

a right foot platform slidingly engaging the right track for linear motion perpendicular to the right hinge axis;

a left foot platform slidingly engaging the left track for linear motion perpendicular to the left hinge axis;

an upright column fixed to the base adjacent the end of the base;

at least one handle attached to the column for grasping by a user while the user is standing upon the platforms, straddling the base, and stretching; and displacement means, mounted upon the column for convenient control by a hand of the user, for moving the platforms along the tracks in either direction simultaneously to maintain equal separations of the right platform from the right side and the left platform from the left side, said displacement means further comprising drum means rotatably mounted on said column, said handle being operatively connected thereto for rotation thereof, and cable means wound about said drum means and connected to said platforms, for moving said platforms together when said drum means are rotated in a first direction by said handle, and for pulling said platforms apart when said drum means are rotated in a second direction, oppositely of said first direction, by said handle;

whereby a user may employ the displacement means to controllably move into and out of a split while standing upon the platforms and straddling the base.

2. A stretching machine according to claim 1, wherein the left track and the right track are each inclined from the horizontal to form equal obtuse angles with the floor in the resting position.

3. A stretching machine according to claim 1, wherein the base includes wheels at an end, whereby, when the tracks are in the elevated storage position the machine may be wheeled from place to place conveniently.

4. A stretching machine according to claim 1, wherein the tracks include distance indicia disposed thereupon for measuring the distance of either platform from the base.

5. A stretching machine according to claim 1, including foot stops on the platforms for preventing the user's foot from sliding therefrom.

6. A stretching machine according to claim 1, wherein the upright column is inclined from the vertical.

7. A stretching machine according to claim 1, wherein the displacement drum and cable means include:

a rotatable drum mounted upon the column;

power means for rotating the drum;

a left retraction cable wound in a clockwise sense around the drum, disposed over left retraction cable pulleys, and attached to the left foot platform to pull toward the base;

left extension cable wound in a counterclockwise sense around the drum, disposed over left extension cable pulleys, and attached to the left foot platform to pull away from the base;

a right retraction cable wound in a clockwise sense around the drum, disposed over right retraction cable pulleys, and attached to the right foot platform to pull toward the base; and a right extension cable wound in a counterclockwise sense around the drum, disposed over right extension cable pulleys, and attached to the right foot platform to pull away from the base;

whereby the right foot platform and the left foot platform may be simultaneously moved toward or away from the base by rotation of the drum.

8. A stretching machine according to claim 7, wherein the power means includes:

a hand crack offset from one end of the drum for exerting torques on the drum;

a ratchet wheel concentrically mounted on the other end of the drum, having ratchet teeth disposed around an outer perimeter of the wheel;

a pawl rotatably mounted on the column for engaging the ratchet teeth;

means for urging the pawl into engagement with the ratchet teeth;

a finger catch on the pawl for exerting finger forces thereupon to oppose the force of the means to disengage the pawl from the ratchet teeth;

whereby the drum may be powered to rotate by the hand crank, locked against rotation by the ratchet, and unlocked by the finger catch.

9. A stretching machine for performing splits comprising:

a pair of foot platforms;

tracking means for restraining the platforms to motion along a pair of respective lines, the lines intersecting to form an obtuse angle therebetween, the lines lying within a vertical plane, and each line inclined at a ramp angle to the horizontal; and linking means for keeping each platform at an equal distance from the intersection of the lines, said linking means further comprising rotatably mounted drum means, means for rotating said drum means, and cable means wound about said drum means and connected to said platforms, for moving said platforms together when said drum means are rotated in a first direction by said drum rotating means, and for pulling said platforms apart when said drum means are rotated in a second direction, oppositely of said first direction, by said drum rotating means;

whereby a user standing above the intersection of the lines with one foot on each platform may do splits to greater than a straight angle.

10. A stretching machine as in claim 9 including power means for energizing the linking means to move the platforms.

11. A stretching machine as in claim 9, including handle means for holding to maintain a user upright in a split.

12. A stretching machine for performing splits comprising:

a track;

foot platforms slidingly mounted on the track;

a first displacement means for positively moving the platforms equal respective distances along the track toward a point midway between the platforms; and a second displacement means for positively moving the platforms equal respective distances along the track away from said point midway between the platforms, said first and second displacement means further comprising rotatably mounted drum means, means for rotating said drum means, and cable means wound about said drum means and connected to said platforms, for moving said platforms together when said drum means are rotated in a first direction by said drum rotating means, and for pulling said platforms apart when said drum means are rotated in a second direction, oppositely of said first direction, by said drum rotating means;

whereby a split is easy to perform in a controlled manner.

13. A stretching machine as in claim 12 including power means for energizing the first and second displacement means to move the platforms.

14. A stretching machine as in claim 12, including handle means for holding to maintain a user upright in a split.

* * * * *